United States Patent [19]

Lloyd

[11] 4,312,536

[45] Jan. 26, 1982

[54] DUNK SEAT

[75] Inventor: Glenn C. Lloyd, Moraine, Ohio

[73] Assignee: Lo-Rich Enterprises, Inc., Miamisburg, Ohio

[21] Appl. No.: 156,595

[22] Filed: Jun. 5, 1980

[51] Int. Cl.[3] ..... A47C 31/00; A47C 5/10

[52] U.S. Cl. ..... 297/217; 297/440; 182/150

[58] Field of Search ..... 297/217, 440; 182/129, 182/73, 206, 150; 52/169.7

[56] References Cited

U.S. PATENT DOCUMENTS

| | | | |
|---|---|---|---|
| 867,178 | 9/1907 | Wiley | 182/150 |
| 1,039,759 | 10/1912 | Knight | 297/440 X |
| 2,604,636 | 7/1952 | Nielsen | 297/217 X |
| 3,011,587 | 12/1961 | Mallog | 182/150 |
| 3,158,223 | 11/1964 | Brown | 182/150 |
| 4,270,799 | 6/1981 | Flaum | 297/440 |

*Primary Examiner*—Francis K. Zugel

*Attorney, Agent, or Firm*—Ralph L. Marzocco

[57] ABSTRACT

A water-immersible seat for use at the edges of swimming pools, on the sides of boats, and over the rims of hydrotherapy equipment is disclosed wherein the amount of immersion of an occupant of the seat can be varied.

3 Claims, 5 Drawing Figures

DUNK SEAT

BACKGROUND OF THE INVENTION (1) Field of the Invention

This invention relates to water-immersible seats for use at the edges of swimming pools, on the sides of boats, and over the rims of hydrotherapy equipment.

(2) Description of the Prior Art

In order to be used in conjunction with a water environment, chairs and seats have been subjected to modification and adaptation to fit particular situational requirements. For example, chairs and seats have been adapted for use in bathtubs for persons required to take sitting baths in the treatment of medical and physical disorders. Seats have been adapted for weight-trimming use on sailboats by providing means for allowing a sailor to place his weight outboard of the sailboat.

BRIEF SUMMARY OF THE INVENTION

This invention provides such a means and device whereby an occupant of a water-immersible seat of the invention can be immersed in water to the extent desired. Quite frequently water in swimming pools of hydrotherapy equipment is heated to such an extent that a significant temperature differential exists between that of the heated water and the ambient. For effective hydrotherapeutic bathing, patients are positioned in such manner as to permit circulation of water in direct contact with afflicted areas. In order to promote maximum comfort for the patient, the unaffected areas of the body are permitted to remain out of the water. Likewise swimmers, because of ambient/water temperature differential, may desire to slowly withdraw from the warmer temperature of the water to the cooler temperature of the ambient, or sunbathers may desire to have only the lower part of their bodies immersed in water, or people who are afraid of water can immerse themselves to the extent desired.

It is an object of this invention to provide a water-immersible seat adapted particularly to support a seat occupant with maximum comfort and safety while such occupant is immersed in water to a desired amount.

Another object of this invention is to provide a water-immersible seat which may be easily installed to and removed from a supporting member and yet is completely stable.

A further object of this invention is to provide a water-immersible seat of simplified construction for economical manufacture that can be easily assembled or disassembled.

The foregoing and other objects and advantages of this invention will appear from the following detailed description taken in connection with the accompanying drawings.

Preferred features of construction have been illustrated and will be specifically described, with the understanding, however, that variations may be made within the scope of the invention as claimed.

DESCRIPTION OF THE PREFERRED EMBODIMENTS

Figures 1, 2, 3, 4:
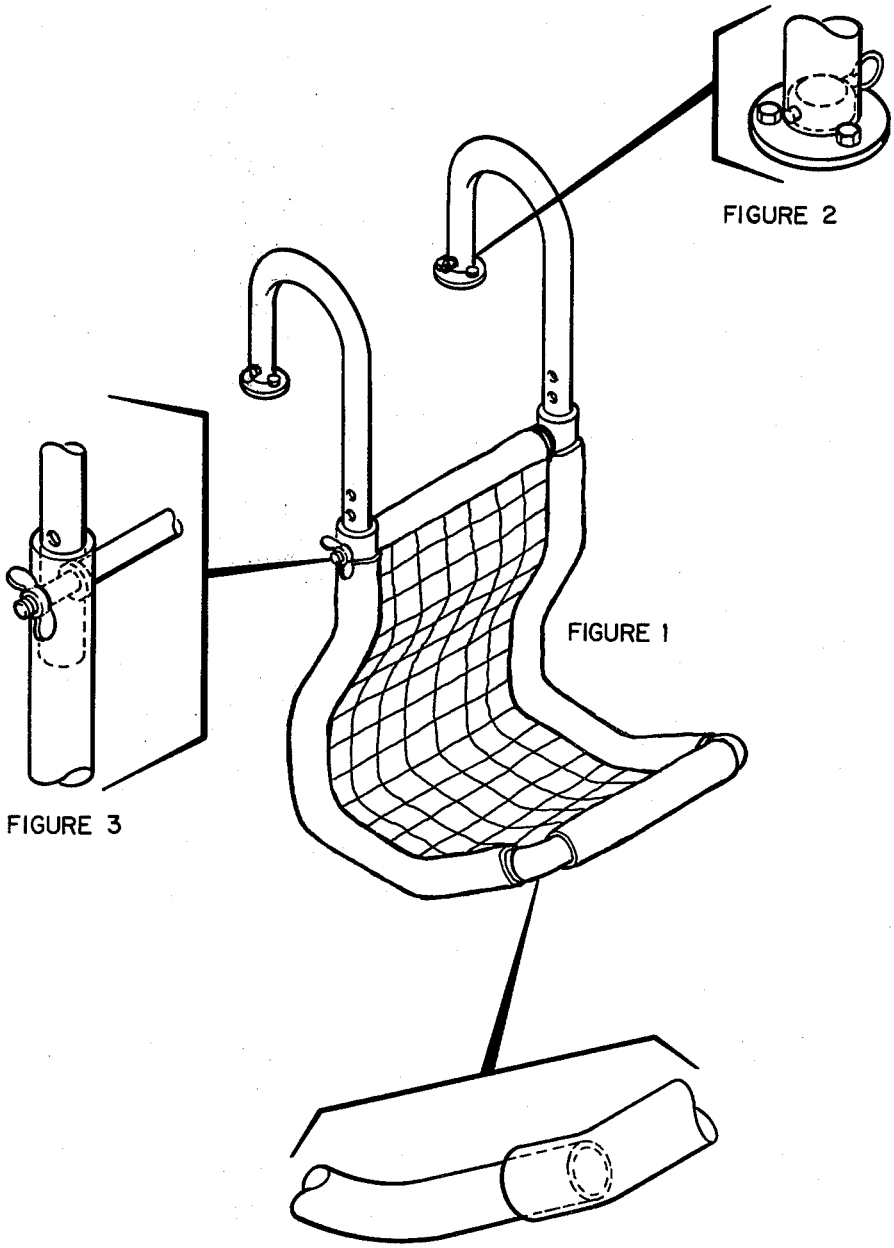
FIG. 1 is an isometric view of a water-immersible seat embodying the features of the present invention.
FIG. 2 is an enlarged isometric view of a deck base plate.
FIG. 3 is an enlarged isometric view of a height-adjustment lock.
FIG. 4 is an enlarged isometric view of the connection of a front horizontal member with a vertical member.
Figure 5:
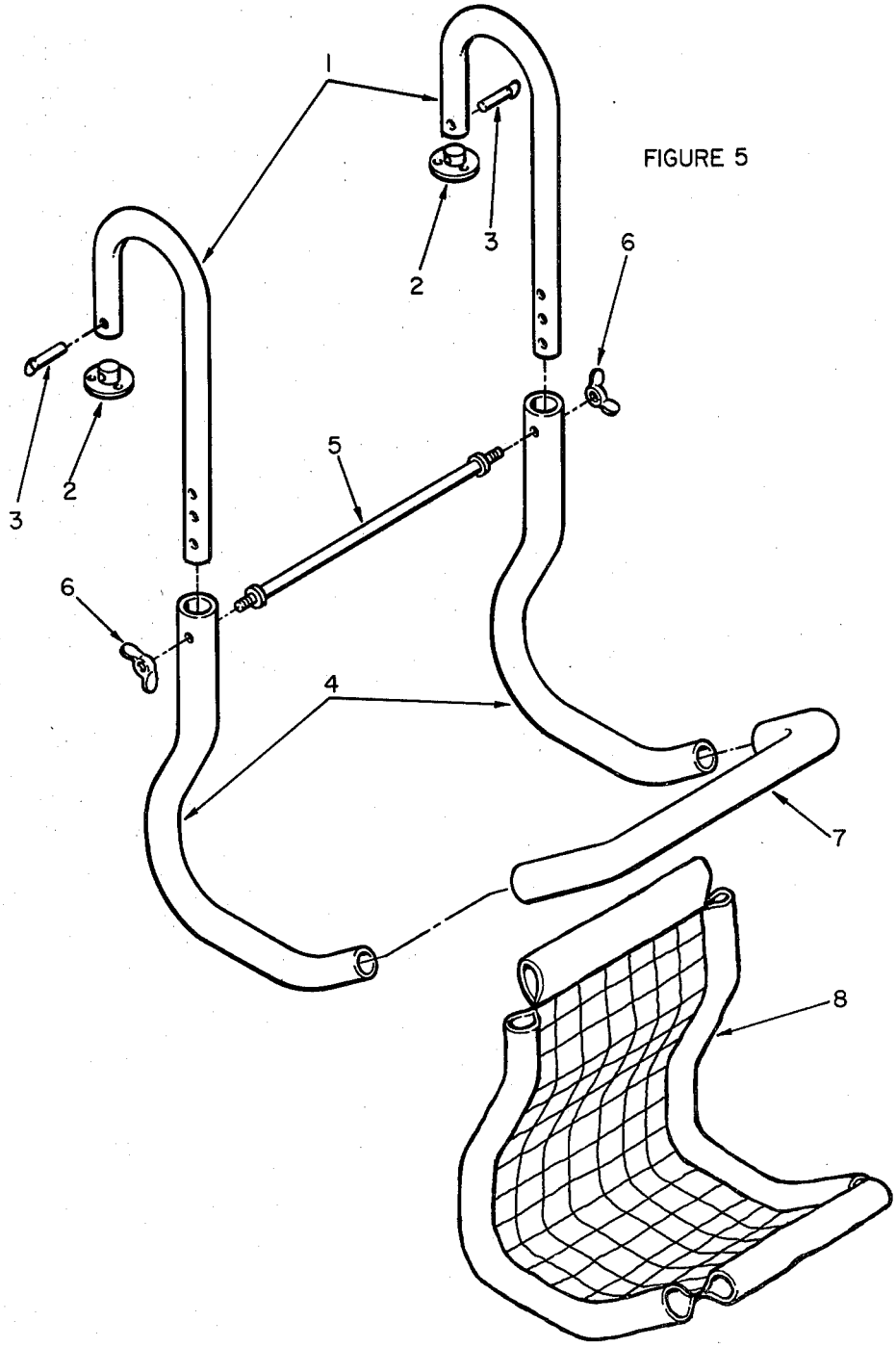
FIG. 5 is a plan view of a water-immersible seat as is shown in FIG. 1.

Referring to FIG. 5, the framework of a water-immersible seat is formed by inserting a right and left vertical hooked rods 1, the upper ends of which are bent laterally and downwardly in the form of hooks, into two other right and left vertical curved rods 4, which may be tubular or which may be solid with the upper portion of such rods 4 hollowed out to permit the insertion of the longer legs of right and left vertical hooked rods 1. Such right and left vertical curved rods are bent backwardly, then downwardly, then laterally, and finally upwardly, as shown in FIG. 5, to which a front horizontal curved tube 7, that is smoothly curved at both ends at an angle of 90 degrees and whose internal diameter is slightly larger than the external diameter of right and left vertical curved rods 4, fits snugly onto right and left vertical curved rods 4, as is shown in FIG. 4. Right and left vertical curved rods 4 are curved backwardly to such an extent necessary so as to permit the waterimmersible seat, when in contact, for example, with the side of a swimming pool, to maintain a vertical position.

A horizontally positioned cross bar 5, both ends of which are threaded to shoulders, connects right vertical hooked rod 1 and right vertical curved rod 4 to left vertical hooked rod 1 and left vertical curved rod 4. This is accomplished by providing a passageway through right and left vertical curved rods 4 and a series of evenly spaced passageways in right and left vertical hooked rods 1. The purpose of the several evenly spaced passageways in right and left vertical hooked rods 1 is to provide means whereby the height of the water-immersible seat can be adjusted.

The shoulder of horizontal cross bar 5 can be provided by having a retaining ring or a nut screwed onto horizontal cross bar 5 or alternatively the unthreaded portion of horizontal cross bar 5 can be larger in diameter than is the diameter of the passageways of right and left vertical hooked rods 1 and right and left vertical curved rods 4.

Referring to FIG. 3, horizontal cross bar 5, after one of its threaded ends pass through the passageways of right vertical curved rod 4 and right vertical hooked rod 1 and the other of its threaded ends pass through the passageways of left vertical curved rod 4 and left vertical hooked rod 1, secures such rods into position by means of wing-tip nuts 6.

The foregoing describes the assembly of the framework of a water-immersible seat and for purposes of clarity the attachment of a back and seat bottom 8 to the framework was omitted.

A back and seat bottom 8 is made of fabric, synthetic or natural, wherein pieces of fabric are stitched or stapled in the form of tubes whereby four such tubes are rectangularly positioned in such a manner as is shown in FIG. 8, open at all ends to permit the passage of tubes or rods, and held together by means of a cross-hatching of synthetic or natural fibers so as to form what is commonly known as a fish-net.

The longer tubes of a back and seat bottom 8 slip over right and left vertical curved rods 4, while one of the shorter tubes of back and seat bottom 8 slips over horizontal curved tube 7 and the other of the shorter tubes slips over horizontal cross bar 5. Because of the design and size of back and seat bottom 8, horizontal curved tube 7 is held firmly attached to right and left vertical curve rods 4 so that along with the snug fit of horizontal curved tube 7 onto right and left vertical curved rods 4, as shown in FIG. 4, no other means for securing this connection are necessary.

The assembled water-immersible seat can be secured to deck of a pool or boat, as is shown in FIG. 2, by means of a base plate 2 having some three holes drilled into such base plate 2 to permit screws to attach such base plate 2 to a deck. As an integral part of base plate 2, a cylindrical rod fits snugly into right and left vertical hooked rods 1, hollowed out to permit the insertion of such cylindrical rod. Toward the ends of the shorter legs of the right and left vertical hooked rods 1 and in the cylindrical rods of base plate 2 passageways are provided for pull-ring pins 3 to secure the water-immersible seat to the deck.

Although the teachings of this invention have herein been discussed with reference to specific embodiments, it is understood that these are by way of illustration only and that others may wish to utilize this invention in different designs or applications.

I claim as my invention:

1. A water-immersible seat comprising a hanger of two vertical rods hooked-shaped at their upper ends with means for securing such seat to a supporting member and having a series of evenly spaced passageways at their lower ends; an inverted ?-shaped back and seat bottom support of two vertical rods with a passageway in each of the hollowed-out upper ends which sleeve onto the lower ends of the rods of said hanger wherein the passageways of the two rods of said support align with the series of evenly spaced passageways of the two rods of said hanger; a horizontal tubular connector having both of its ends bent at a ninety degree angle which sleeve onto the lower ends of said support; a horizontal bar lock-connector for securing the lower ends of said support in height adjustable positions; and a back and seat bottom fish netting attached to four tubes of rectangularly positioned fabric that sleeves onto the support, the tubular connector, and the bar lock-connector.

2. A water-immersible seat as defined in claim 1 wherein such seat is secured to a deck base plate with pull-ring pins that insert into passageways at the ends of the shorter legs of the two hooked-shaped vertical rods.

3. A water-immersible seat as defined in claim 1 wherein the hanger of such seat hooks over the rim of a supporting member.

* * * * *